US011014793B2

(12) United States Patent
Saleh

(10) Patent No.: US 11,014,793 B2
(45) Date of Patent: May 25, 2021

(54) SIDE LOADING ATTACHMENT FOR FORKLIFT TRUCKS

(71) Applicant: Mohamad Saleh, Concord (CA)

(72) Inventor: Mohamad Saleh, Concord (CA)

( * ) Notice: Subject to any disclaimer, the term of this patent is extended or adjusted under 35 U.S.C. 154(b) by 0 days.

(21) Appl. No.: 16/587,026

(22) Filed: Sep. 29, 2019

(65) Prior Publication Data

US 2020/0102196 A1 Apr. 2, 2020

Related U.S. Application Data

(60) Provisional application No. 62/740,370, filed on Oct. 2, 2018.

(51) Int. Cl.
*B66F 9/14* (2006.01)

(52) U.S. Cl.
CPC ..... *B66F 9/141* (2013.01)

(58) Field of Classification Search
CPC ..... B66F 9/141
See application file for complete search history.

(56) References Cited

U.S. PATENT DOCUMENTS 3,106,305 A 10/1963 Gehring
3,166,209 A 1/1965 Haddock, Jr.
3,561,620 A 2/1971 Willis
3,659,733 A 5/1972 Sinclair
3,672,526 A 6/1972 Hansen
3,747,790 A * 7/1973 Smith, Jr. ..... B66F 9/141 414/663
3,762,588 A 10/1973 Hansen
3,786,952 A 1/1974 Nearman
3,836,031 A 9/1974 Weisker
3,850,322 A 11/1974 Miles
3,854,616 A 12/1974 Willis
3,977,550 A * 8/1976 Crawford ..... B66F 9/141 414/659
3,998,345 A 12/1976 Fiehler
4,636,131 A 1/1987 Sinclair
4,708,575 A 11/1987 Farmer
6,611,746 B1 * 8/2003 Nagai ..... B66F 9/0755 187/222
6,758,649 B1 7/2004 Scordilis
7,766,596 B2 * 8/2010 Smith ..... E04G 21/168 414/11
8,306,703 B1 11/2012 Saleh
(Continued)

*Primary Examiner* — Saul Rodriguez
*Assistant Examiner* — Ashley K Romano

(57) ABSTRACT

In accordance with one embodiment of the present invention, a side loading attachment (40) for use with a forklift truck (70) having a pair of forwardly extended forklift forks (70F). The attachment (40) comprises a pair of hollow sleeves (42) to receive the forklift forks (70F). A support frame (41) is welded to the hollow sleeves (42). A sliding bracket (43) is slidably mounted to the support frame (41). A rotatable shaft (45) is rotatably mounted to the sliding bracket (43). A tiltable frame (44) is pivotally mounted to the rotatable shaft (45). An elevating carriage (46) is slidably mounted to the tiltable frame (44). A pair of load forks (40F) are mounted to the elevating carriage (46) whereby the load forks (40F) can be rotated and shifted to either side of the forklift truck (70) and can be elevated and tilted to deposit or retrieve a palletized load (30) to either side of the forklift truck (70) in a narrow aisle operation.

6 Claims, 11 Drawing Sheets

(56) References Cited

U.S. PATENT DOCUMENTS

2003/0185660 A1* 10/2003 Kafka ..... B66F 9/141
414/619
2006/0263182 A1* 11/2006 Mizner ..... B60P 1/4421
414/462

* cited by examiner

SIDE LOADING ATTACHMENT FOR FORKLIFT TRUCKS

CROSS-REFERENCE TO RELATED APPLICATIONS

This application claims the benefits of provisional patent application No. 62/740,370 filed Oct. 2, 2018 by the present inventor.

FEDERALLY SPONSORED RESEARCH

Not Applicable

SEQUENCE LISTING OR PROGRAM

Not Applicable

BACKGROUND

Field

This application relates to forklift trucks attachments.

Prior Art

Conventional forklift trucks specifically counterbalance forklift trucks are extensively used in warehouses. However, their use is restricted in narrow aisles because they can't load or unload to the side of the forklift truck. Special forklift trucks which are used in narrow aisles are relatively costly in both initial and operating costs.

Several side loading attachments for conventional forklift trucks have been proposed. U.S. Pat. No. 3,672,526 issued Jun. 27, 1972 for Howard C. Hansen shows a removable side loading attachment with its forks starting after the forklift forks to be able to pick-up a palletized load at ground level. This attachment severely increases the distance between the load being carried and the forklift which leads to a considerable decrease in the load capacity of the forklift truck. U.S. Pat. No. 3,998,345 issued Dec. 21, 1976 to Raymond H. Fiehler shows a removable side loader for forklift trucks which has the ability to pick up or release only limited height loads which can fit between the attachment forks and the fixed forks of the forklift truck. The height and the location of this attachment under the forklift forks may also prevent the forklift from depositing a load to the top racks close to the warehouse ceiling.

U.S. Pat. No. 3,659,733 issued May 2, 1972 and U.S. Pat. No. 4,636,131 issued Jan. 13, 1987 both for Stuart W. Sinclair and U.S. Pat. No. 6,758,649 issued Jul. 6, 2004 for Frank P. Scordilis show fixed attachments for forklift trucks having shiftable forks for side loading. Modifying a forklift is very costly and the forklift will not be able to perform the same job which it was designed for by the manufacturer.

U.S. Pat. No. 8,306,703 B1 issued Nov. 6, 2012 to the present inventor Mohamad Saleh was another attempt to introduce a practical side loading attachment for the forklift trucks. However, locating the attachment forks on a support arm which was extended to one side of the support frame created a huge unbalanced bending moment on the support frame, the guide frame and the sliding bracket and made it very hard to fabricate an actual working attachment which can be carried by a forklift truck and shift a load to the side of the truck.

BRIEF SUMMARY OF THE INVENTION

This invention permits a conventional forklift truck having a pair of forwardly extending forks to be converted quickly to a narrow aisle truck. An attachment where a support frame is secured to the forklift forks by a pair of hollow sleeves welded to the support frame, a sliding bracket is slidably mounted to the support frame, a rotatable shaft is rotatably mounted to the sliding bracket, a tiltable frame is pivotally mounted to the rotatable shaft, an elevating carriage is slidably mounted to the tiltable frame, and a pair of load forks are secured to the elevating carriage. The attachment is controlled by a wireless remote control transmitter and receiver so the load forks can be shifted and rotated to either side of the forklift truck and can be elevated and tilted to level a palletized load during side loading operation.

It is an object of the present invention to provide a side loading attachment which can be mounted upon a conventional forklift truck or a material handling vehicle to enable pick up or release a load to either side of the forklift truck.

Still a further object of the present invention is to provide a side loading attachment which is simple in design, durable in usage, compact in size, was actually made and tested successfully with parts commercially available in the market so it can be economically produced.

Still a further object of the present invention is to provide a side loading attachment which can deposit or retrieve a palletized load at ground level to either side of the forklift truck.

Still a further object of the present invention is to provide a side loading attachment to enable the forklift truck to retrieve or deposit a palletized load to the side of the truck close to the front of forklift truck to maintain adequate side loading capacity for the forklift truck.

Yet a further object of the present invention is to provide a side loading attachment which requires little or no change in the construction of the forklift truck and can be mounted or removed from the truck at a substantial speed.

DETAILED DESCRIPTION OF THE INVENTION

Figure 1:
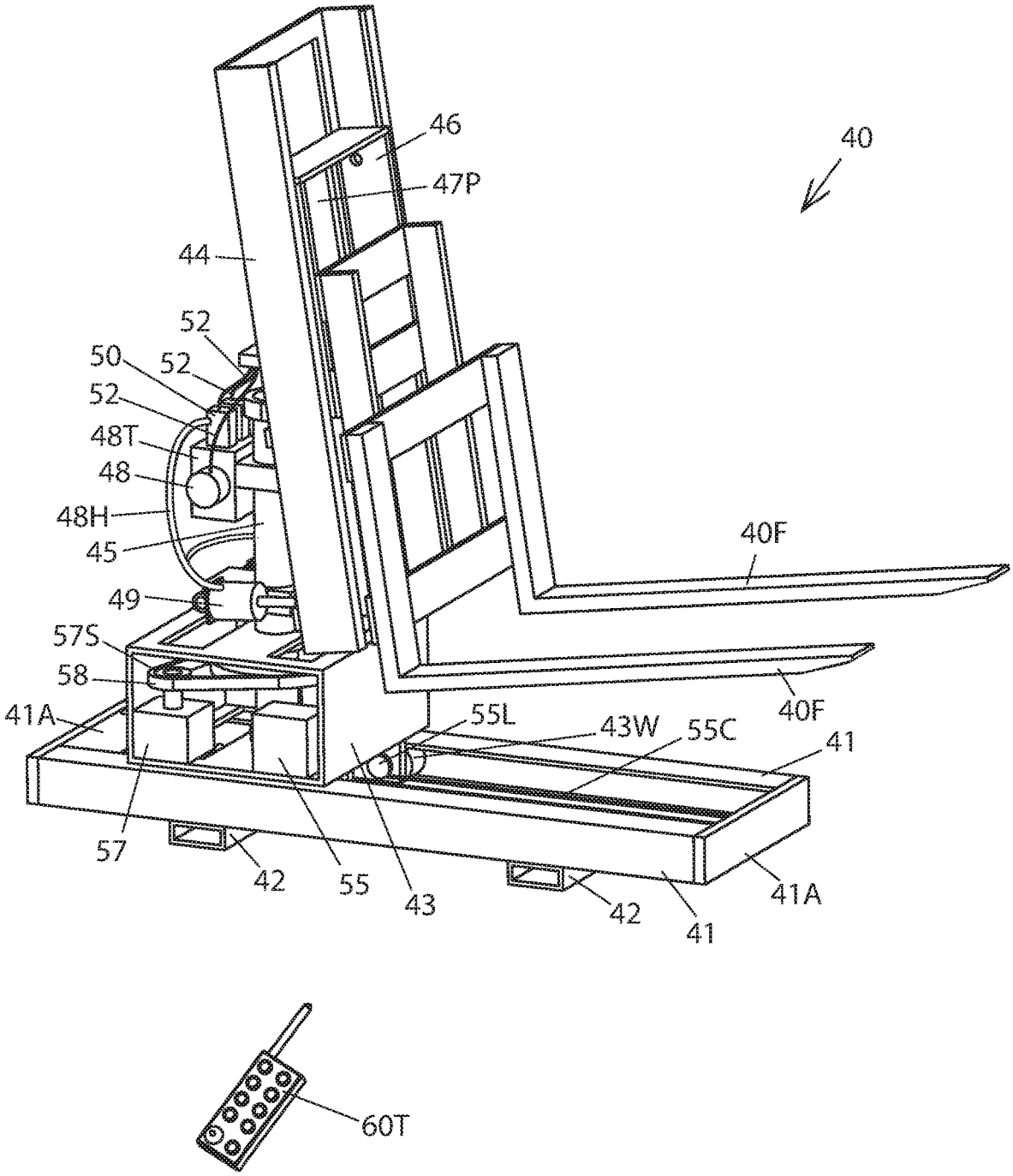
FIGS. 1 and 2 are perspective views of the attachment and its remote control.
Figure 4:
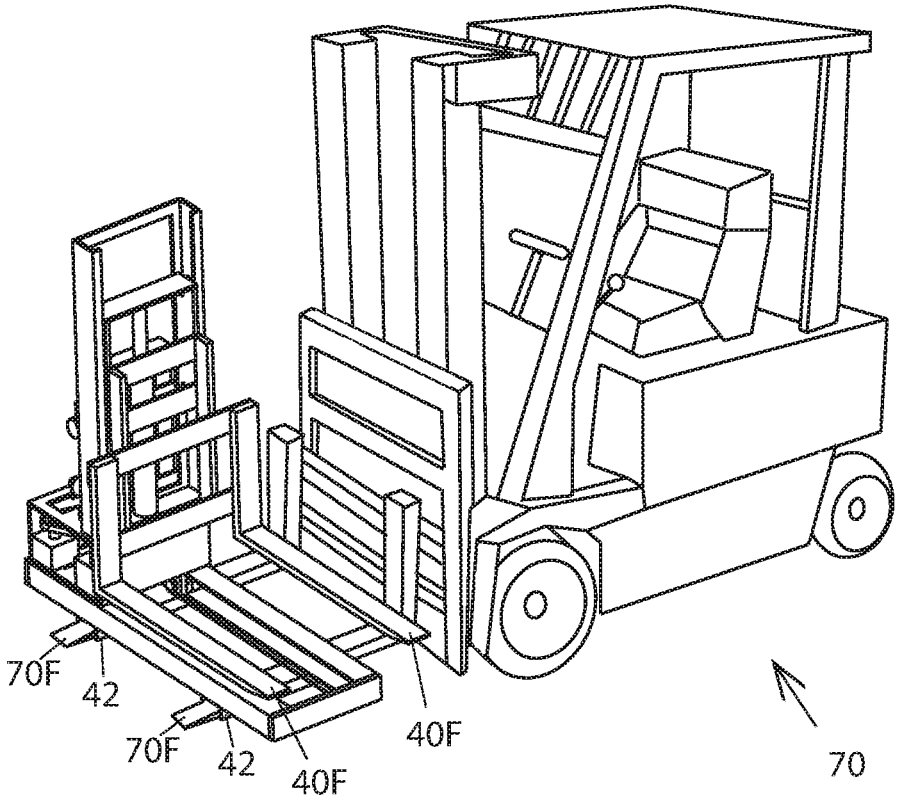
FIG. 4 is a perspective view of a forklift truck carrying the attachment.

Referring to FIGS. 1 and 4, an attachment generally designated entirely by the numeral 40 is carried by a counterbalance forklift truck 70 which has a pair of forklift forks 70F.

Referring to FIGS. 1 to 6, the attachment 40 comprises a support frame 41 which has a pair of end plates 41A. The support frame 41 is welded to a pair of hollow sleeves 42 to receive the forklift forks 70F. A sliding bracket 43 is mounted to four sliding wheels 43W which run inside the support frame 41. A rotatable shaft 45 is secured to a pair of bearings 45B which are mounted to the sliding bracket 43. A tiltable frame 44 is pivotally mounted to the rotatable shaft 45 by a bracket 45C. The tiltable frame 44 is also pivotally mounted to a pair of hydraulic tilting cylinders 49. The bases of the hydraulic tilting cylinders 49 are pivotally mounted to a bracket 49B which is bolted or welded to the rotatable shaft 45. The tiltable frame 44 can be tilted by extending or retracting the tilting cylinders 49. An elevating carriage 46 is mounted to four elevating wheels 46W which run inside the tiltable frame 44. A pair of load forks 40F are secured to the lower extended section of the elevating carriage 46 best shown in FIG. 5. The method of pressing and securing the rotatable shaft 45 to the bearings 45B is well known to those with ordinary skills in the mechanical art.

Figure 2:
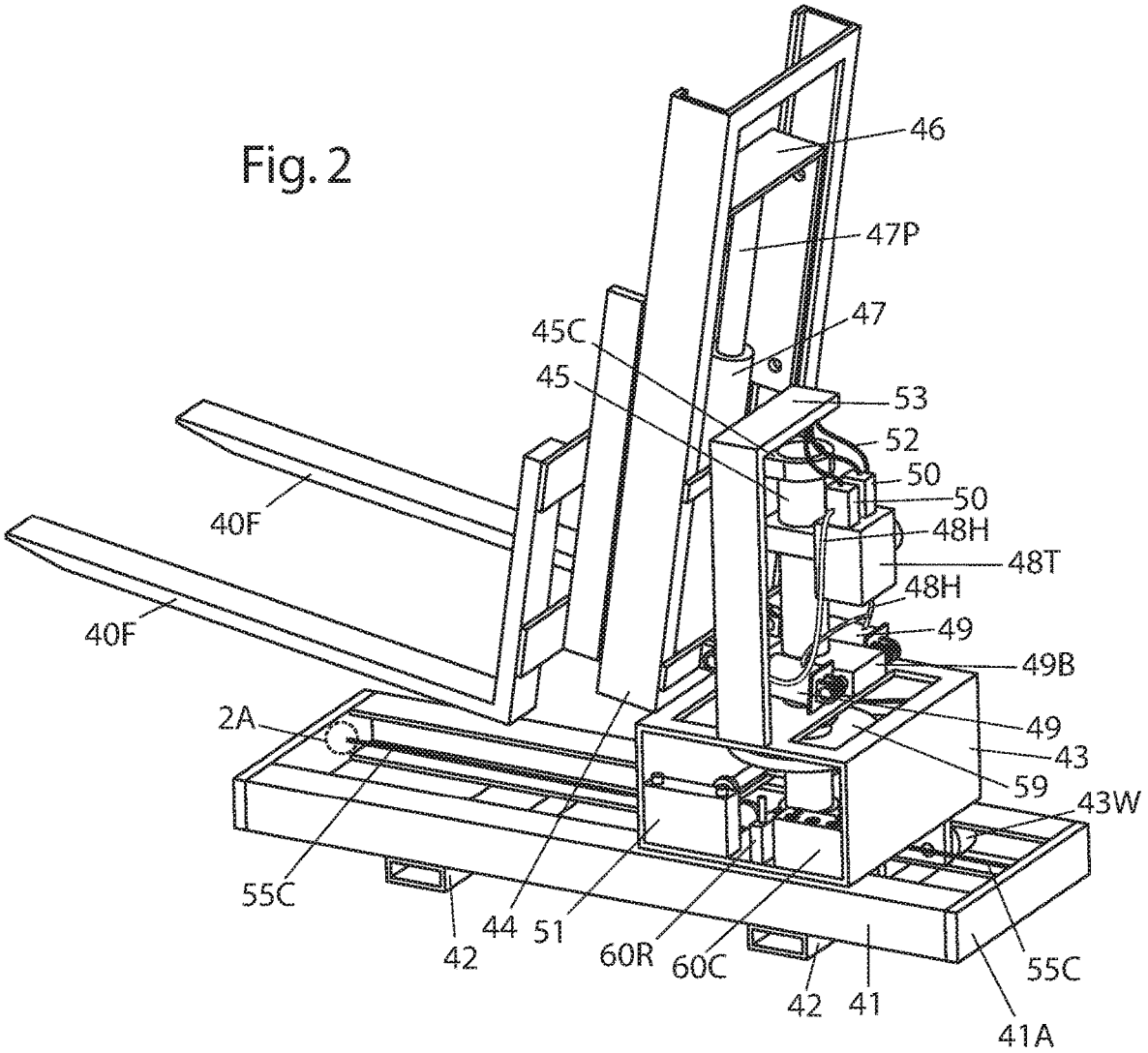
Figure 5:
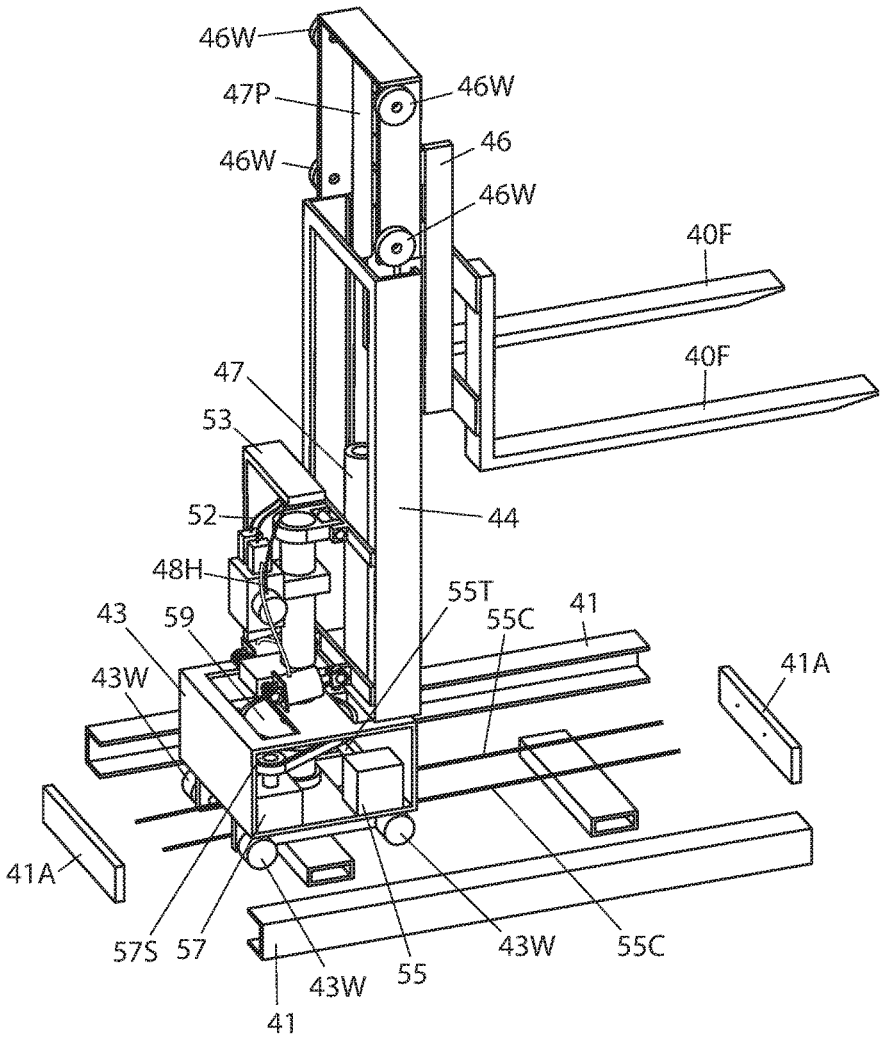
FIG. 5 is an exploded view of the attachment.
Figure 6:
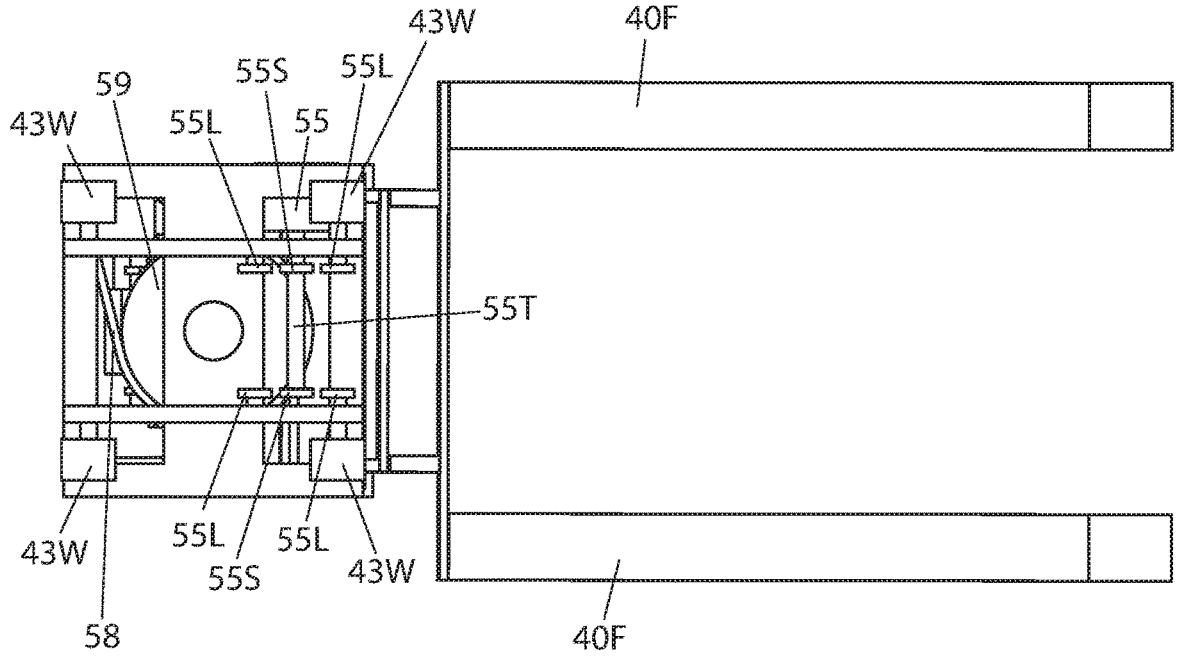
FIGS. 6 and 6A are bottom and perspective views of the attachment with some parts omitted for clearer view of inside parts.
Figure 6A:
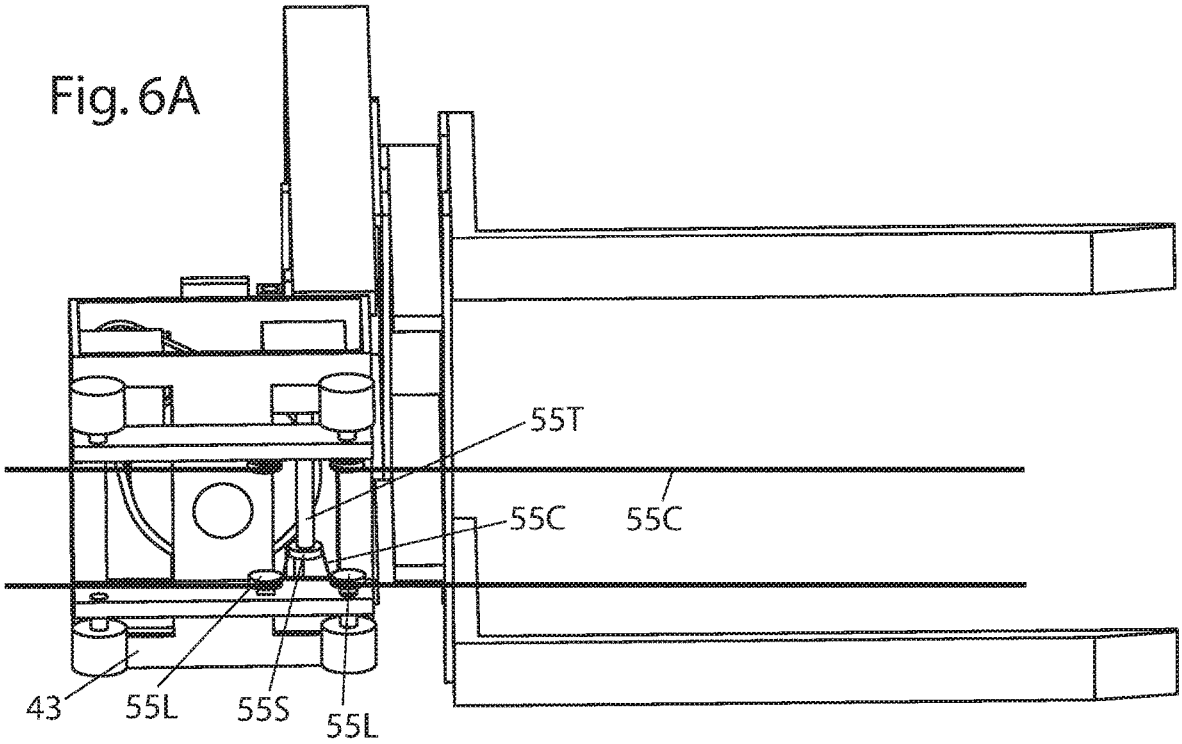
Figure 8:
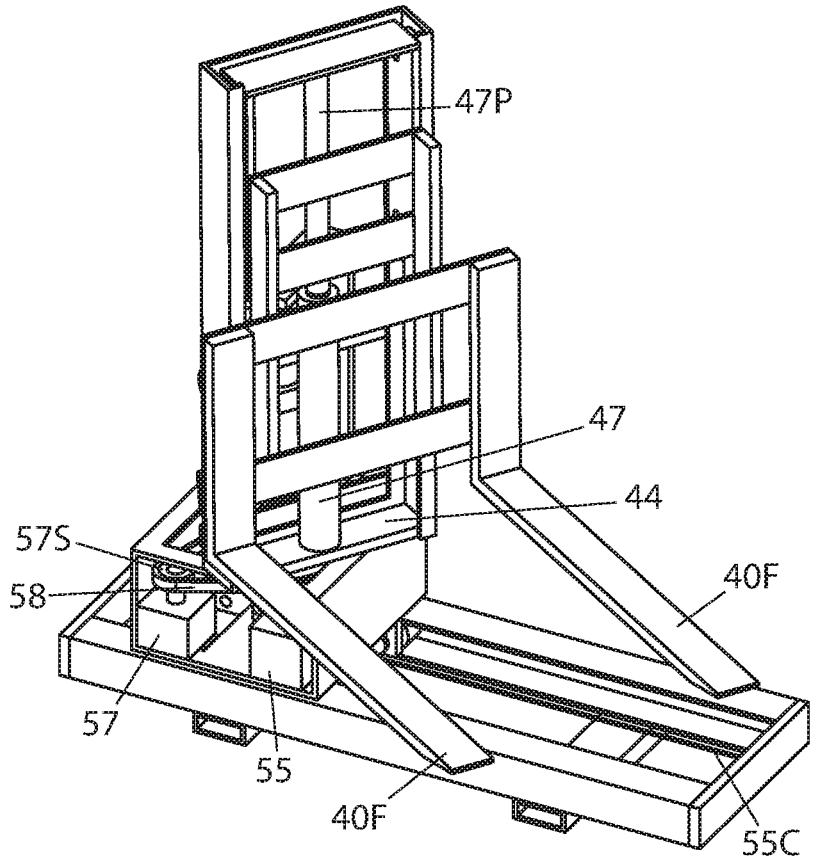
FIG. 8 is a perspective view of the attachment load forks partially rotated.
Figure 8A:
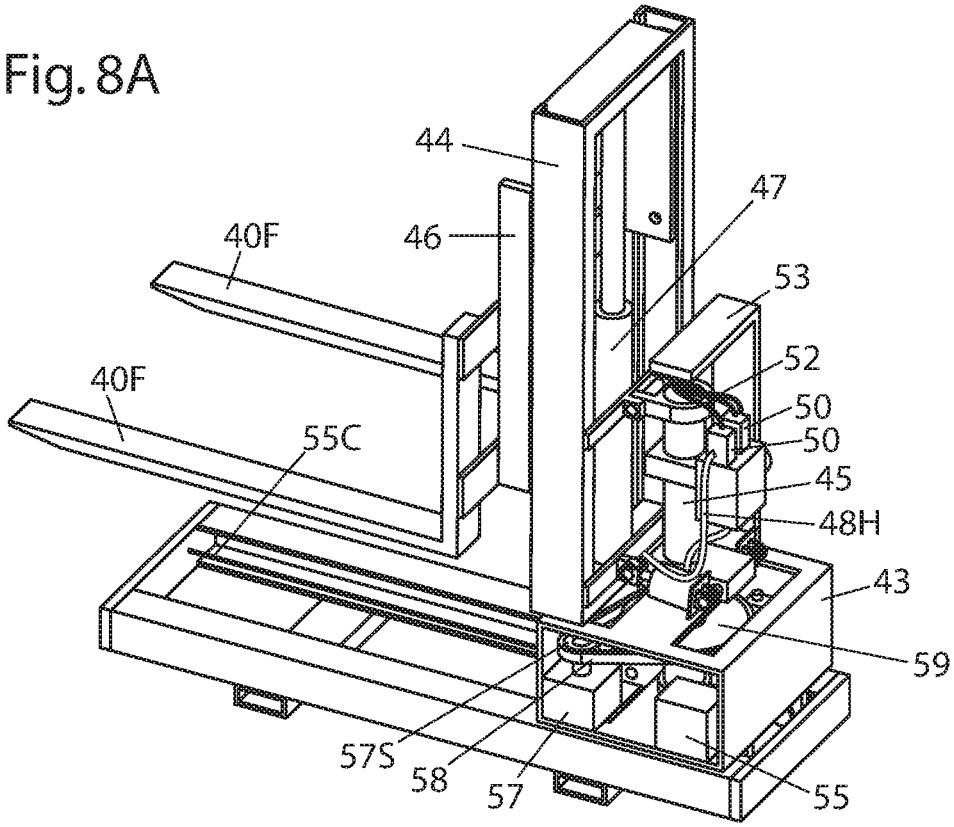
FIG. 8A is a perspective view of the attachment load forks fully rotated.

Referring to FIGS. 2, 5 and 8, a hydraulic elevating cylinder 47 is rigidly mounted to the base of the tiltable frame 44, the elevating cylinder 47 has a piston 47P which is rigidly mounted to the elevating carriage 46. The elevating carriage 46 and the load forks 40F can be raised or lowered by extending or retracting the elevating cylinder 47.

Figure 2A:
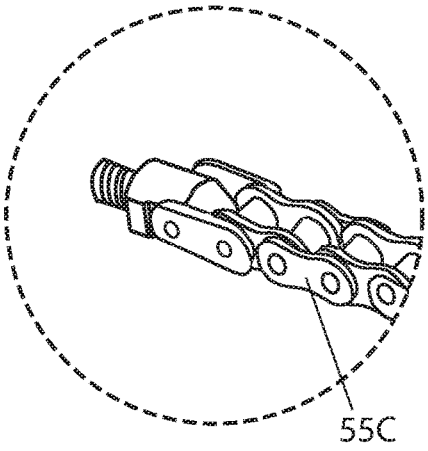
FIG. 2A is an enlarged view of the area 2A in FIG. 2.
Figure 3:
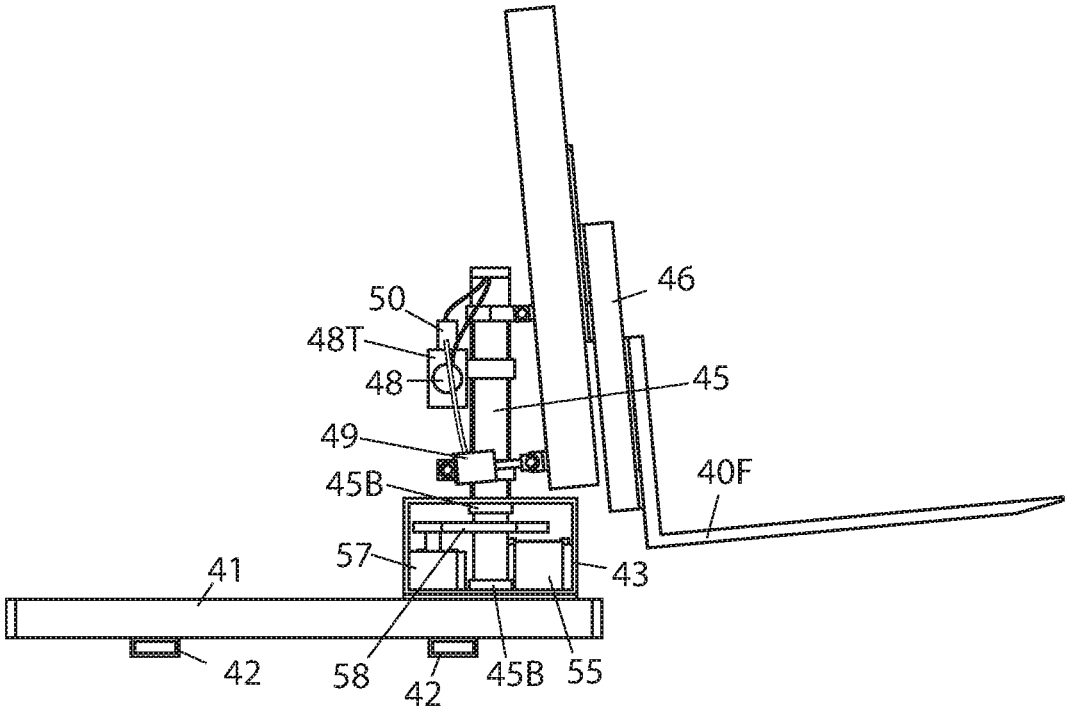
FIG. 3 is a side view of the attachment.

Referring to FIGS. 1, 2, 2A, 5, 6 and 6A, a reversible electrical side shifting gear motor 55 is rigidly mounted to the base of the sliding bracket 43. The side shifting motor 55 has a shaft 55T. A pair of side shifting sprockets 55S are rigidly mounted to the shaft 55T. A pair of side shifting roller chains 55C are riding on the sprockets 55S. Each of the side shifting chains 55C is connected from both ends to the inside of the end plates 41A and riding on a pair of idler sprockets 55L. The idler sprockets 55L enable the side shifting chains 55C to pass from under the sliding bracket 43 to the inside of the sliding bracket 43 to ride on the side shifting sprockets 55S then run back under the sliding bracket 43. When the side shifting motor 55 rotates it causes the shaft 55T and the side shifting sprockets 55S to rotate and causes the sliding bracket 43 to move along the support frame 41. It should be noted that the support frame 41, the end plates 41A and the hollow sleeves 42 were omitted from FIGS. 6 and 6A for clearer view of inside parts. The side shifting chains 55C were also omitted from FIG. 6 for clearer view of the idler sprockets 55L. The method of connecting the side shifting chains 55C to the end plates 41A best shown in FIG. 2A is well known to those with ordinary skills in the mechanical art.

Figure 9:
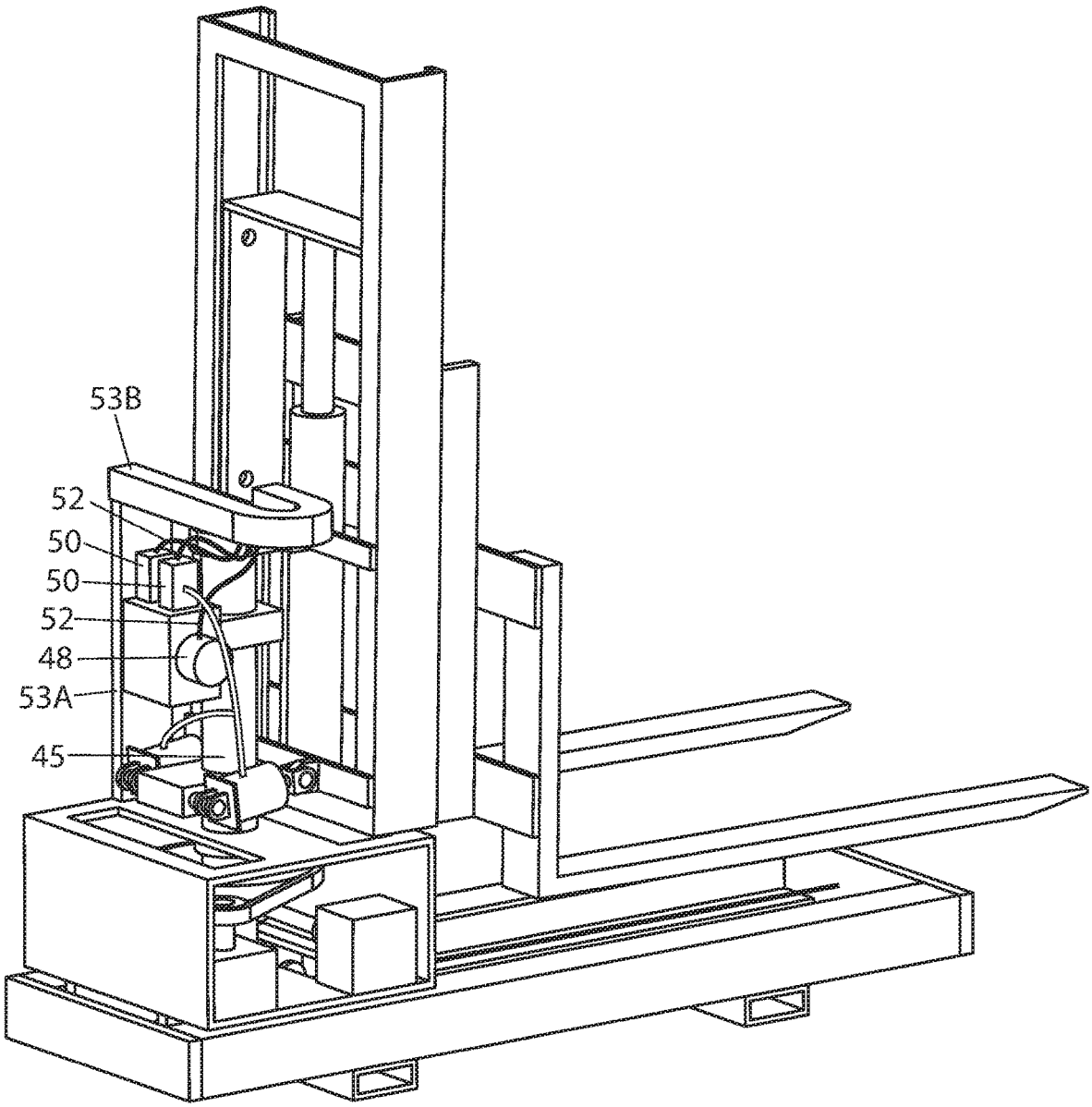
FIG. 9 is a perspective view of an alternative method of wiring some of the attachment components.

Referring to FIGS. 1, 2, 9, 10 and 10A, an electric hydraulic pump 48 receives hydraulic fluid (not shown) from a hydraulic tank 48T. The hydraulic pump 48 provides hydraulic pressure to the elevating cylinder 47 and the tilting cylinders 49 through a pair of electric hydraulic directional valves 50 and a group of flexible hydraulic hoses 48H. The hydraulic valves 50 and the electric hydraulic pump 48 receive electrical power from a rechargeable battery 51 through flexible electrical conductors 52. The electrical conductors 52 run in a hollow cable tray 53 which is welded or bolted to the sliding bracket 43. The flexible electrical conductors 52 exit the cable tray 53 above the centre of the rotatable shaft 45 so there is minimal twisting of the flexible electrical conductors 52 when the rotatable shaft 45 rotates by 180 degrees. Alternatively, the electrical conductors 52 run partially inside a hollow cable tray 53A which is mounted on the sliding bracket 43 and continue to run in a flexible drag chain cable carrier 53B which is secured from one end to the cable tray 53A and to the rotatable shaft 45 from the other end as shown in FIG. 9. The flexible drag chain cable carrier 53B allows the rotatable shaft 45 to rotate 180 degrees without damaging the flexible electrical conductors 52.

Referring to FIGS. 1, 2, 3, 4, 6, 8 and 8A, a reversible electrical rotating gear motor 57 having a sprocket 57S is rigidly mounted to the sliding bracket 43. A rotating roller chain 58 is riding on the sprocket 57S. The rotating chain 58 is also riding on a sprocket 59 which is mounted on the rotatable shaft 45. When the rotating motor 57 receives electrical power from the battery 51 it rotates the sprocket 59, the rotatable shaft 45, the tiltable frame 44, the elevating carriage 46 and the load forks 40F. The elevating cylinder 47 has to be extended so that the load forks 40F are higher than the sliding bracket 43 while rotating them to the desired side of the forklift 70.

Figure 10:
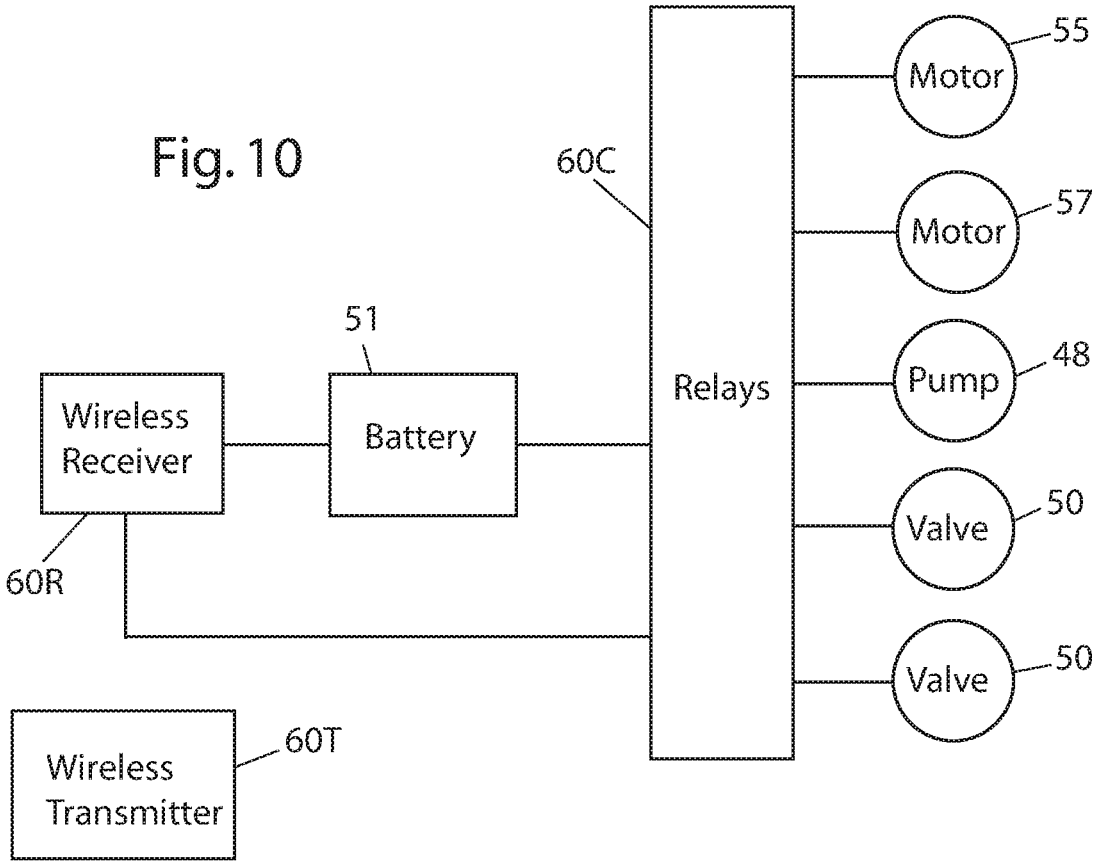
FIGS. 10 and 10A are block diagrams showing the electrical and hydraulic connections of the attachment.
Figure 10A:
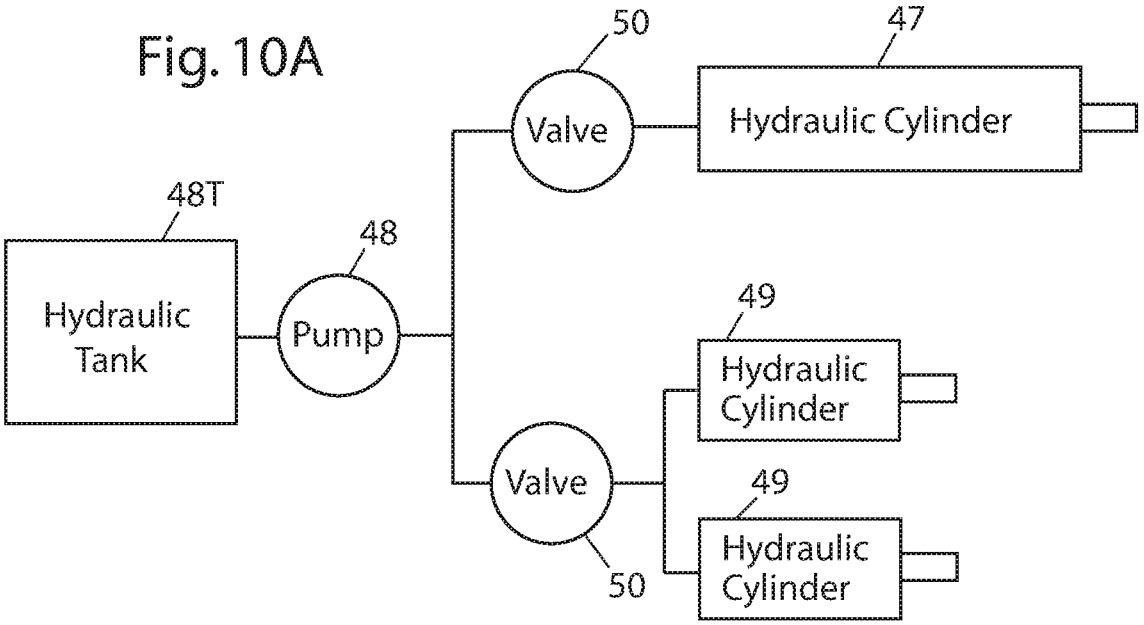

Referring to FIGS. 1, 2 and 10, a wireless remote control transmitter 60T sends control signals (not shown) to a wireless receiver 60R which receives electrical power from the battery 51. The receiver 60R is wired to and controlling a group of electrical contactors or relays 60C. The relays 60C are connected or wired to the battery 51, the side shifting motor 55, the rotating motor 57, the hydraulic pump 48 and the hydraulic valves 50. The relays 60C are standard direct current relays and the method of wiring them is well known to those with ordinary skills in the electrical art. The wireless remote control transmitter 60T and the receiver 60R are standard wireless controllers used usually for wireless crane control and available commercially from many suppliers. It should be mentioned that the electrical relays 60C are used because the receiver 60R can't provide high electrical current directly from the battery 51 to the electrical side shifting motor 55, the rotating motor 57 and the hydraulic pump 48. Alternatively, if the receiver 60R is rated for high current then the relays 60C can be eliminated from the attachment 40.

In view of the previous the operation of the attachment 40 should be apparent. Referring to FIGS. 1, 2, 10 and 10A, a forklift driver (not shown) using the transmitter 60T sends control signals to the receiver 60R which activates the relays 60C to send electrical power from the battery 51 to the hydraulic pump 48 and the directional hydraulic valves 50 to extend or retract the elevating cylinder 47 and the tilting cylinders 49. The driver using the transmitter 60T can also send control signals to the receiver 60R to activate the relays 60C to send electrical power to the side shifting motor 55 and the rotating motor 57 to rotate them in the desired direction.

Referring to FIGS. 1, 2, 4, 5, 7, 7A, 7B and 7C, when the forklift driver wants to pick up a palletized load 30 at ground level to place it on a rack (not shown) in a narrow aisle (not shown) he or she inserts the forklift forks 70F in the attachment hollow sleeves 42, raises the forklift forks 70F by normal operation of the forklift truck 70, then carries the attachment 40 and places it in front of and facing the palletized load 30. The driver then uses the transmitter 60T to send control signals to the receiver 60R to retract the elevating cylinder 47 to lower the load forks 40F to be just above the horizontal section of the forklift forks 70F (usually called blades). The driver then activates the side shifting motor 55 to advance the load forks 40F to engage the palletized load 30. The driver then extends the elevating cylinder 47 to raise the load forks 40F and the palletized load 30 to be higher than the support frame 41, then activates the side shifting motor 55 in the reverse direction to bring the palletized load 30 above the support frame 41. After that the driver raises the forklift forks 70F and drives the forklift 70 to enter the narrow aisle with the palletized load 30. Placing the palletized load 30 on the rack is done by placing it in front of and facing the desired rack, activating the side shifting motor 55 to shift the load forks 40F and place the palletized load 30 slightly above the rack then retracting the elevating cylinder 47 to lower and release the load 30 on the rack then retrieve the load forks 40F by activating the side shifting motor 55 in the reverse direction. The forklift driver can level the load forks 40F and the palletized load 30 whenever needed during loading or unloading operations by using the transmitter 60T to extend or retract the tilting cylinders 49 to tilt the load forks 40F to the desired level.

Figure 11:
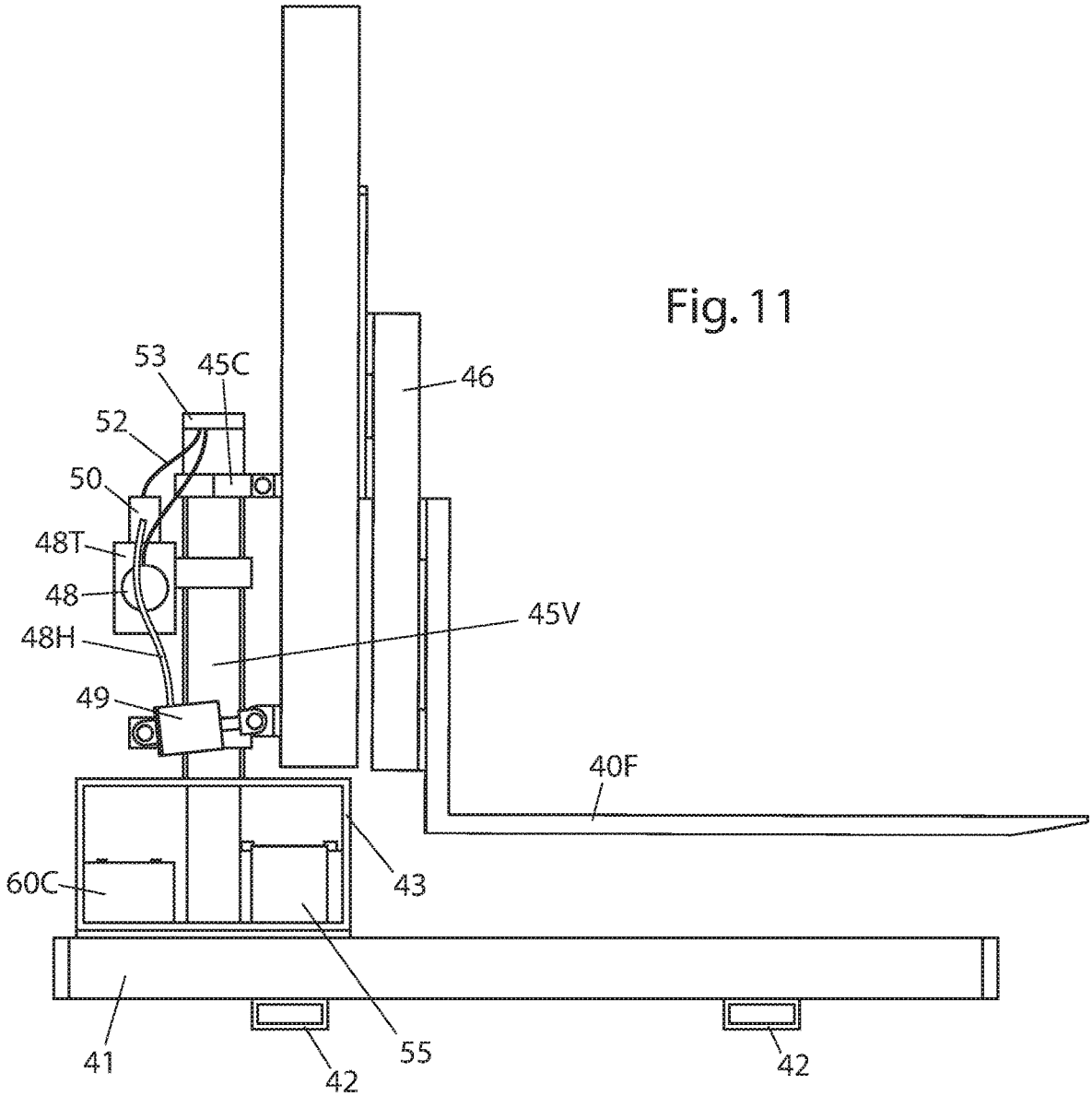
FIG. 11 is an alternative embodiment of the attachment.

Referring to FIGS. 1, 2, 3, 4, 7 and 11, the forklift driver can insert the forklift forks 70F from either side of the hollow sleeves 42 to load or unload the palletized load 30 to the left or to the right of the forklift truck 70 without rotating the load forks 40F. In this case the rotating motor 57, the chain 58, the sprocket 59 and the bearings 45B can all be eliminated from the attachment 40. In this case the rotatable shaft 45 is replaced by a fixed vertical shaft or a vertical bracket 45V which can be welded or bolted directly to the sliding bracket 43 as shown in FIG. 11. This embodiment is less expensive to fabricate and is useful if side loading operations are not needed very often.

Various components can be incorporated in the attachment 40. Referring to FIGS. 1, 2 and 4 limit switches (not shown) can be used to cut electrical power from the side shifting motor 55 when the sliding bracket 43 reaches the end plates 41A in either direction. Limit switches (not shown) can also be used to cut electrical power from the rotating motor 57 when the rotatable shaft 45 is fully rotated to either side of the forklift 70. Speed controllers (not shown) can be used to adjust the speed of the rotating motor 57 and the side shifting motor 55. A stopper (not shown) can be used to keep enough distance between the attachment 40 and the forklift 70 so the load forks 40F don't hit the forklift 70 while they travel during side shifting operation. An automatic level controller (not shown) can also be used to extend or retract the tilting cylinders 49 to keep the load forks 40F leveled all the time during side loading operation.

Various changes can be made without departing from the scope of the invention. For example in FIGS. 1, 2, 4, 5, 6, 6A and 7, the side shifting chains 55C can be replaced by a rack and a pinion (not shown) to move the sliding bracket 43 along the support frame 41. The electrical side shifting motor 55 and the electrical rotating motor 57 can both be replaced by hydraulic motors (not shown). The hydraulic pump 48, the hydraulic tank 48T and the hydraulic valves 50 can all be placed inside the sliding bracket 43 and the hydraulic hoses 48H can run inside the cable tray 53 to provide hydraulic pressure to the elevating cylinder 47 and the tilting cylinders 49. An electrical battery charger (not shown) can also be placed inside the sliding bracket 43 to charge the rechargeable battery 51. The hydraulic pump 48, the tank 48T, the hoses 48H, the valves 50 can all be eliminated from the attachment 40 if we replace the hydraulic elevating cylinder 47 and the hydraulic tilting cylinders 49 with electric linear actuators (not shown) or with electric hydraulic actuators (not shown) which are self-contained and operate solely by electrical power. The hydraulic pump 48 and the hydraulic tank 48T can also be eliminated from the attachment 40 if the hydraulic valves 50 receive hydraulic pressure directly from the forklift 70 through quick hydraulic connections (not shown). A wired controller (not shown) can also be used instead of the wireless transmitter 60T and receiver 60R.

Figure 7:
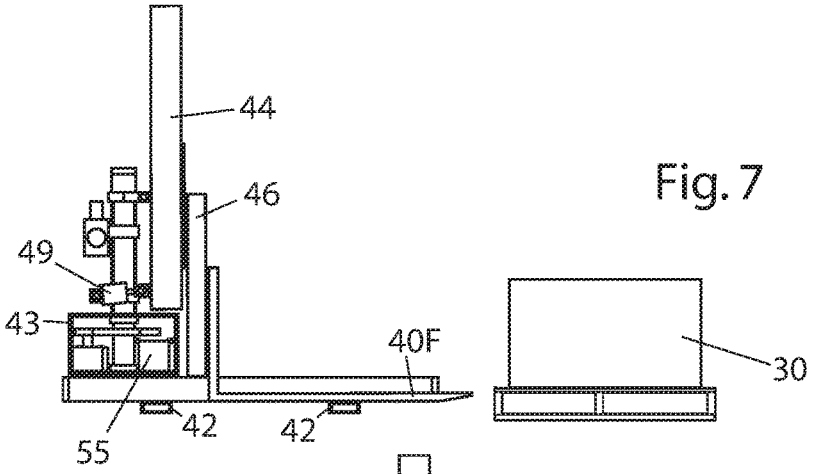
FIGS. 7, 7A, 7B and 7C show how the attachment load forks can engage and retrieve a palletized load at ground level.
Figure 7A:
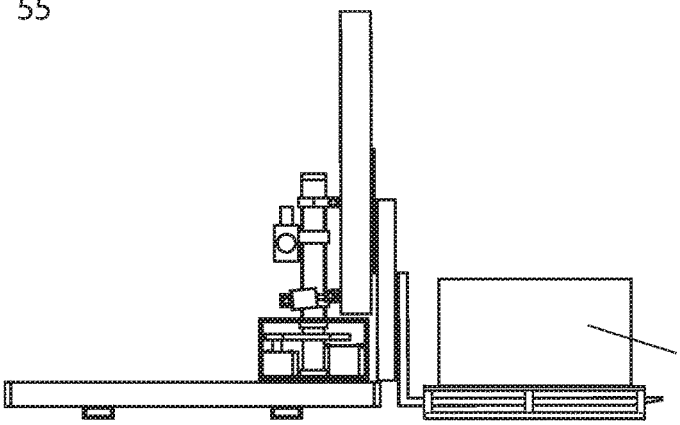
Figure 7B:
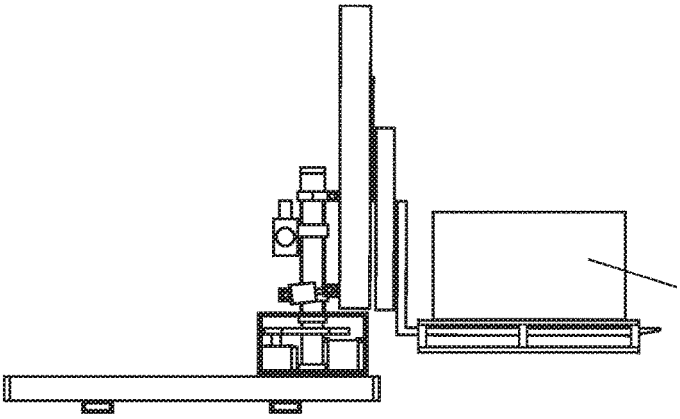
Figure 7C:
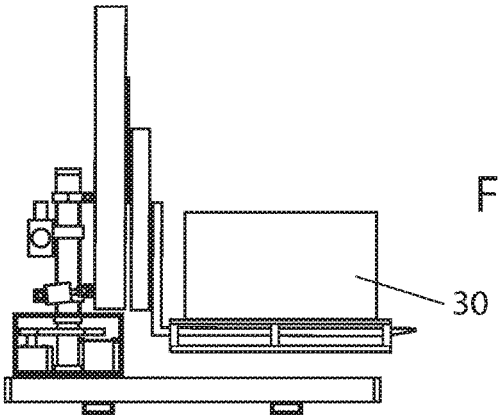

Referring to FIGS. 1 and 7, the load forks 40F can be mounted slidably on the elevating carriage 46 to accommodate different widths of the palletized load 30.

Referring to FIG. 2, the elevating cylinder 47 and the tilting cylinders 49 can be double acting hydraulic cylinders or single acting hydraulic cylinders which are retracted by gravity.

I claim:

1. A remotely controlled side loading attachment for use with a forklift truck having a pair of forwardly extending forks, said attachment comprising:

a pair of hollow sleeves to receive said forklift forks;

a support frame rigidly secured to said hollow sleeves;

a sliding bracket slidably mounted to said support frame;

first drive means to effect movement of said sliding bracket along said support frame;

a rotatable shaft rotatably mounted to said sliding bracket;

second drive means to effect rotation of said rotatable shaft on said sliding bracket;

a tiltable frame pivotally mounted to said rotatable shaft;

third drive means to effect movement of said tiltable frame to said rotatable shaft;

an elevating carriage slidably mounted to said tiltable frame;

a pair of load forks mounted to said elevating carriage;

fourth drive means to effect movement of said elevating carriage to said tiltable frame wherein said fourth drive means can lower said elevating carriage to deposit each fork of said pair of load forks to one side of said support frame adjacent to the horizontal section of said forklift forks;

a group of electrical contactors connected to said first, second, third and fourth drive means;

a remote control to control said group of electrical contactors; and an electrical power source to provide electrical power to said group of electrical contactors;

whereby a driver of said forklift truck using said remote control can shift and rotate said load forks to either side of said forklift truck and can elevate and tilt said load forks relatively to said forklift forks and can lower said load forks to be adjacent to the horizontal section of said forklift forks then shift said load forks to engine a palletized load at ground level to the side of said forklift truck then raise said load forks and said palletized load higher than said support frame then shift said load forks back to bring said palletized load above said support frame adjacent to the vertical section of said forklift forks.

2. The attachment of claim 1 wherein said electrical power source is a rechargeable battery.

3. The attachment of claim 1 wherein said remote control comprises a wireless transmitter and a wireless receiver.

4. A remotely controlled side loading attachment for use with a forklift truck having a pair of forwardly extending forks, said attachment comprising:

a pair of hollow sleeves open at both ends to receive said forklift forks from either end;

a support frame rigidly secured to said hollow sleeves;

a sliding bracket slidably mounted to said support frame;

first drive means to effect movement of said sliding bracket along said support frame;

a vertical bracket rigidly mounted to said sliding bracket;

a tiltable frame pivotally mounted to said vertical bracket;

second drive means to effect movement of said tiltable frame to said vertical bracket;

an elevating carriage slidably mounted to said tiltable frame;

a pair of load forks mounted to said elevating carriage;

third drive means to effect movement of said elevating carriage to said tiltable frame wherein said third drive means can lower said elevating carriage to deposit each fork of said pair of load forks to one side of said support frame adjacent to the horizontal section of said forklift forks;

a group of electrical contactors connected to said first, second and third drive means;

a remote control to control said group of electrical contactors;

an electrical power source to provide electrical power to said group of electrical contactors;

whereby a driver of said forklift truck using said remote control can shift said load forks to the side of said forklift truck and can elevate and tilt said load forks relatively to said forklift forks and can lower said load forks to be adjacent to the horizontal section of said forklift forks then shift said load forks to engage a palletized load at ground level to the side of said forklift truck then raise said load forks and said palletized load higher than said support frame then shift said load forks back to bring said palletized load above said support frame adjacent to the vertical section of said forklift forks.

5. The attachment of claim 4 wherein said electrical power source is a rechargeable battery.

6. The attachment of claim 4 wherein said remote control comprises a wireless transmitter and a wireless receiver.

* * * * *